United States Patent [19]

McBrian

[11] 3,955,183

[45] May 4, 1976

[54] ALARM CONDITION SENSING AND INDICATING CIRCUIT WITH TEST CAPABILITY

[75] Inventor: John E. McBrian, Bethel, Conn.

[73] Assignee: The Mosler Safe Company, Hamilton, Ohio

[22] Filed: Mar. 21, 1975

[21] Appl. No.: 560,051

Related U.S. Application Data

[63] Continuation-in-part of Ser. No. 539,042, Jan. 6, 1975, abandoned.

[52] U.S. Cl. ..... 340/214; 324/51; 340/412

[51] Int. Cl.[2] ..... G08B 19/00

[58] Field of Search ..... 340/214, 409; 324/51, 324/133

[56] References Cited

UNITED STATES PATENTS

| | | | |
|---|---|---|---|
| 2,664,795 | 1/1954 | Tone | 340/214 |
| 2,944,252 | 7/1960 | Muehter | 340/214 |
| 3,562,730 | 2/1971 | Hill | 340/214 |

*Primary Examiner*—Thomas B. Habecker

*Attorney, Agent, or Firm*—Wood, Herron & Evans

[57] ABSTRACT

An alarm circuit includes an alarm condition indicating section having an alarm indicator, such as a lamp, and a power supply therefor, the lamp becoming illuminated in response to sensing of an alarm condition. Also included is an alarm condition sensing element, such as a normally open switch or a photoconductor normally incident with a low level of light, which under normal conditions, i.e., in the absence of an alarm condition, exhibits a very high impedance, but which in response to an alarm condition exhibits a low impedance. The alarm condition sensing element is connected to the alarm condition indicator and in response to the sensing of an alarm condition and being placed in its low impedance condition causes the alarm indicator to provide an alarm indication. A circuit is also provided for testing the operability of both the alarm indicator power supply and the continuity therefrom to the alarm sensing element, which test circuit accomplishes its test function without actually placing the alarm condition sensing element in an alarm condition or electrically simulating the circuit conditions which exist when such is done.

17 Claims, 3 Drawing Figures

ALARM CONDITION SENSING AND INDICATING CIRCUIT WITH TEST CAPABILITY

Figure 1:
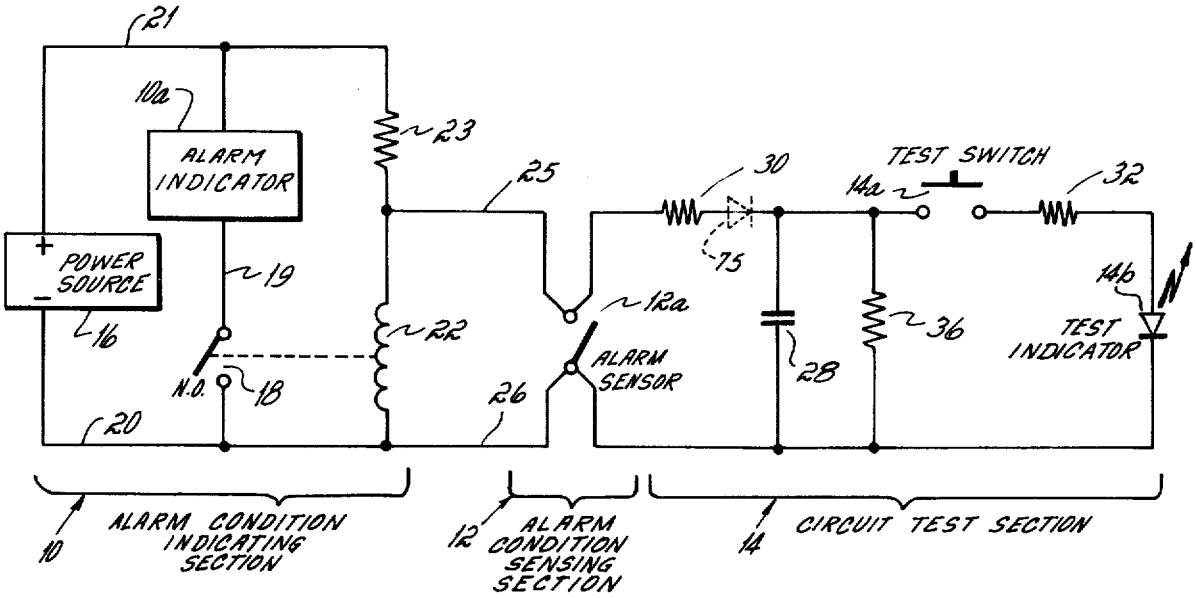

This is a continuation-in-part of application Ser. No. 539,042, filed Jan. 6, 1975, and now abandoned.

This invention relates to alarm condition sensing and indicating circuits, and more particularly circuits of this type having the capability of checking the operability of the alarm indicator power supply and the continuity therefrom to the alarm sensing element without actually placing the circuit in alarm condition or electrically simulating the circuit conditions which result when the circuit is placed in an alarm condition.

Alarm circuits of the type to which this invention relates typically include an alarm sensing element, such as a normally open switch or photoconductor normally incident with a low level of light, which exhibits a high impedance under normal conditions, i.e., in the absence of an alarm condition, but which exhibit a low impedance when an alarm condition is sensed. Associated with the alarm condition sensing element is an alarm indication circuit which includes an alarm indicator, such as a lamp or siren, and a power supply therefor, the lamp or siren providing a humanly perceptible alarm indication when the alarm sensing element is placed in its low impedance condition in response to the sensing thereby of an alarm condition.

In practice it has been found desirable to check, or test, from time-to-time, both the operability of the power supply which energizes the alarm indicating lamp or siren as well as the line continuity between the alarm indicator power supply and the alarm condition sensing element which in response to an alarm condition triggers the alarm indicator placing it in an alarm indicating mode. Should the power supply become inoperative and/or the continuity between the power supply and the alarm condition sensing element become interrupted, the alarm condition indicator would fail to provide an indication that an alarm condition has occurred notwithstanding that the alarm condition sensing element has effectively sensed the occurrence of the alarm condition. By testing the alarm indicator power supply and continuity therefrom to the alarm sensing element, malfunctions can be detected and corrected, avoiding the situation wherein an alarm condition occurs and is sensed, but due to an undetected failure of the alarm indicator power supply and/or interruption of the wiring between the power supply and the alarm condition sensor, an alarm indication is not given and the alarm condition goes unnoticed.

In accordance with past proposals, testing of alarm circuits has typically been accomplished by actually placing the alarm condition sensing element in an alarm condition and observing whether the alarm indicator produces an alarm indication. In accordance with a variant of this approach, instead of actually placing the alarm sensing element in an alarm condition, the electrical input from the alarm sensing element to the alarm indication circuit is simulated with the result that the alarm indicating circuit responds to the simulated alarm signal input thereto and if operative produces an alarm indication. With the latter approach, the alarm indicator is placed in an alarm mode without actually placing the alarm condition sensing element in an alarm mode.

In accordance with both of the foregoing testing schemes, the operative condition of the alarm indicator is sensed by actually actuating the alarm indicator and the result thereof, either production of an alarm indication or nonproduction thereof, is observed. If an alarm indication is produced, the test results are considered favorable; if not, the alarm condition sensing and/or indicating circuitry is considered to be inoperative.

Alarm circuit test arrangements of the type noted are unsatisfactory under certain circumstances. For example, if the alarm circuit testing scheme is of the type wherein the alarm sensing element is actually placed in an alarm condition to test the operability of the alarm indicating circuit, when the circuit is being tested it is necessary to notify the personnel monitoring the alarm indicator that the alarm system is being intentionally placed in an alarm mode for test purposes. Otherwise, such monitoring personnel will falsely believe that an alarm condition has actually occurred, that is, a false alarm will result, when in fact only a test is being made. Alerting personnel monitoring the alarm indicator that a test is in progress is particularly inconvenient when the alarm indicator and the alarm condition sensing element are separated by a considerable distance, such as occurs when the alarm sensing element is located at, for example, a bank vault and the alarm indicator is located at police headquarters.

Accordingly, it has been an objective of this invention to provide an alarm sensing and indicating circuit of the type wherein a normally high impedance alarm sensing element is switched to a low impedance state in response to detection of an alarm condition, which circuit can be checked with respect to both power supply operability and line continuity without the necessity of actually placing the alarm sensing element in an alarm mode or electrically simulating the circuit conditions which exist when the alarm sensing element is placed in an alarm mode.

The foregoing objective has been accomplished in accordance with certain principles of this invention by (a) connecting to the alarm sensing element an energy storage device, preferably a capacitor, which when the alarm indicator power supply is operative and continuity therefrom to the alarm sensing element exists will charge to slightly less than the open circuit voltage customarily present across the normally high impedance alarm sensing element, and (b) placing a series-connected normally open test switch and test indicator across the capacitor. When the test switch is momentarily closed, the capacitor, assuming it has charged by reason of the operativeness of the alarm indicator power supply and the existence of line continuity therefrom to the alarm condition sensing element, will discharge through the test indicator and provide an indication that both the alarm indicator power supply is operative and line continuity exists. Thus, with an arrangement of this type both the operability of the alarm indicator power supply and the existence of line continuity can be checked by merely momentarily closing a test switch and observing a test indicator. Moreover, such can be done without actually placing the alarm sensing element in an alarm mode or electrically simulating the circuit conditions which exist when the alarm sensing element is placed in an alarm mode.

In accordance with a further aspect of the invention, means are provided for preventing a false positive test indication from being produced should the power supply for the alarm indicator and continuity therefrom to the alarm sensing element have existed for a period sufficient to charge the capacitor and thereafter, but prior to actuation of the test switch, become inoperative. Under such circumstances, that is, with a power supply or continuity malfunction after the capacitor has charged, but before the test switch is actuated, when the test switch is actuated the charged capacitor would discharge through the test indicator providing a positive, albeit incorrect, indication of the operativeness of the alarm indicator power supply and continuity therefrom to the alarm condition sensing element. In accordance with this further aspect of the invention, the foregoing false positive problem is eliminated by placing a resistor across the capacitor. The resistor enables the capacitor to charge when the alarm indicator power supply is operative and line continuity exists, but permits the charge on the capacitor to dissipate once either the power supply has become inoperative or an interruption in line continuity has occurred, thereby preventing a false positive test indication when the test switch is subsequently actuated.

In accordance with a still further aspect of the invention, particularly suitable where multiple alarm condition sensors and associated circuit testers are connected across a single alarm condition indicator, the false positive problem is eliminated by placing a normally nonconducting transistor across the capacitor. The normally nonconducting transistor enables the capacitor to charge when the alarm indicator power supply is operative and line continuity exists, but is switched to a conductive state to discharge the capacitor when either the power supply has become inoperative or an interruption in line continuity has occured, thereby preventing false positive test indication when the test switch is subsequently actuated. The advantage of placement of a transistor across the capacitor, instead of a conventional resistor, is that under normal operating conditions the transistor shunting the capacitor is nonconductive and exhibits a very high impedance. As such, when multiple alarm condition sensors and associated circuit testers each having a capacitor and shunting transistor are connected in parallel across a single alarmn condition indicator, the net resistance of the parallel network of alarm condition sensors and associated circuit testers when none of the alarm sensors has been actuated is sufficiently high to avoid shunting the control relay of the alarm condition indicator which, if permitted to occur, would provide a false alarm indication.

Figure 2:
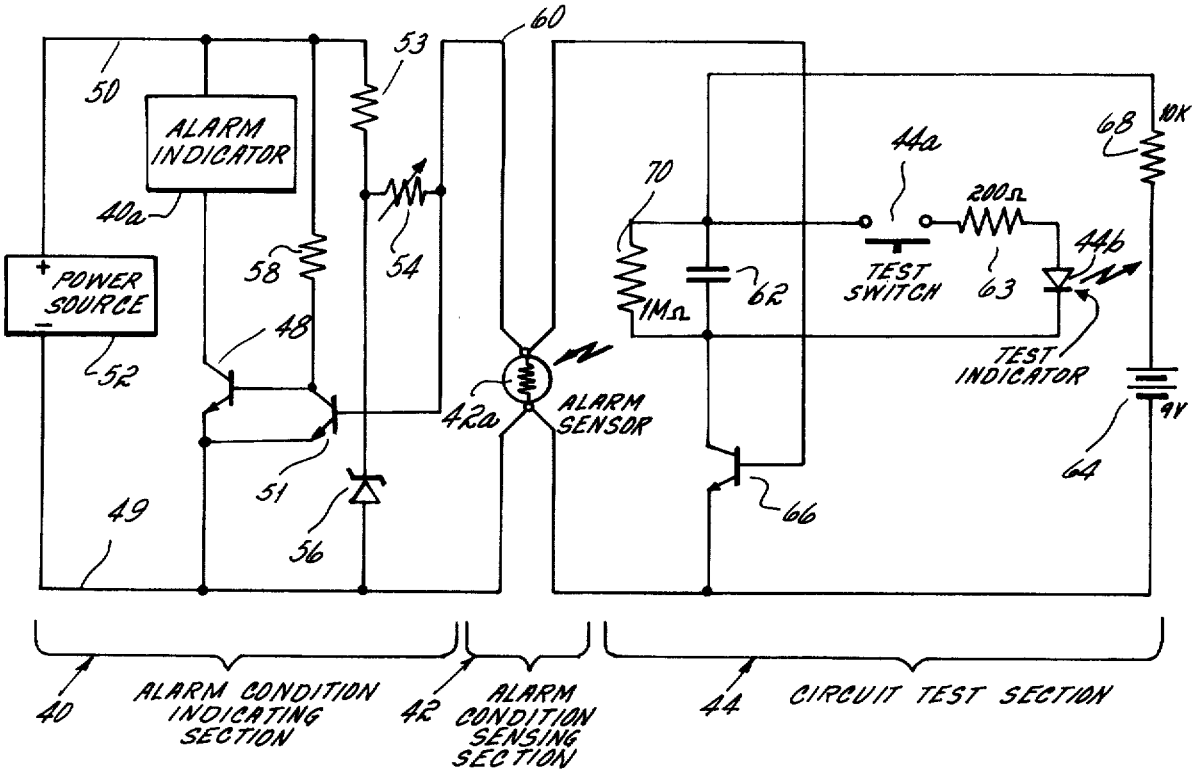
Figure 5:
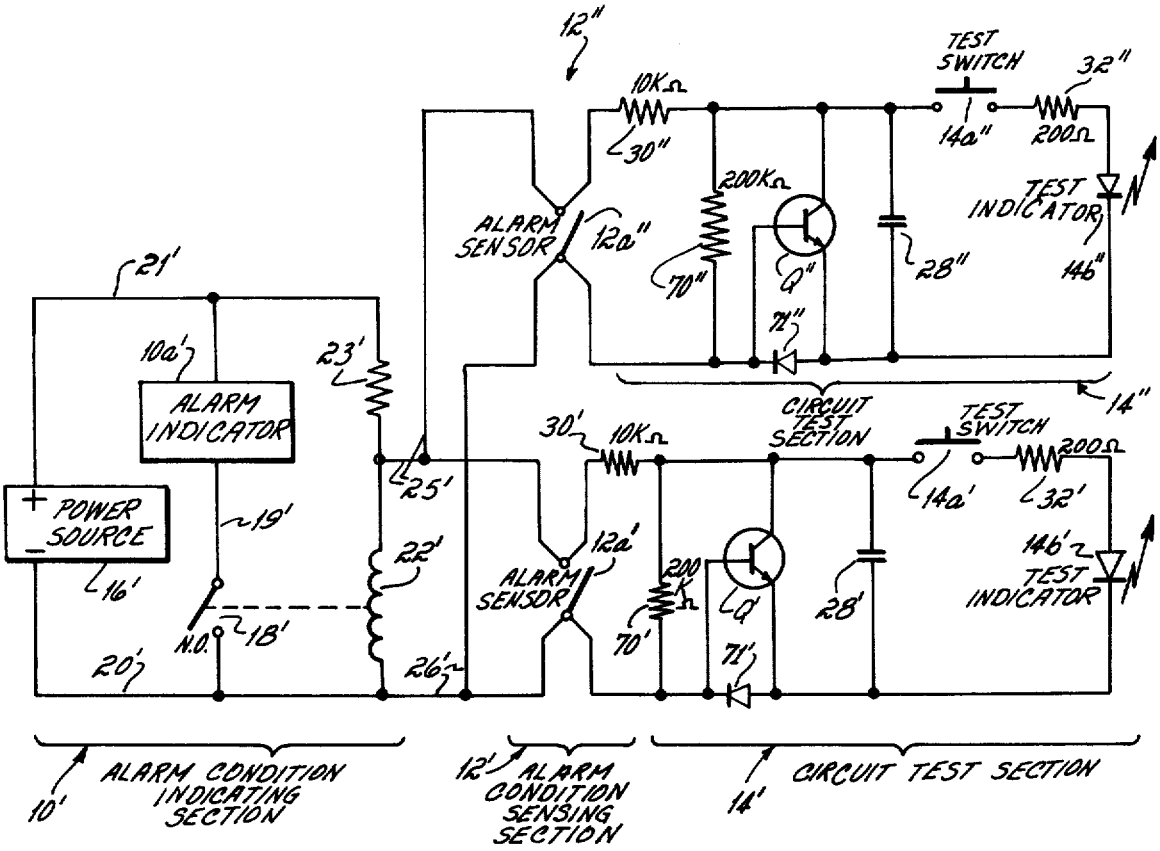

These and other advantages and objectives of the invention will become more readily apparent from a detailed description thereof taken in conjunction with the drawings in which:

FIG. 1 is a shematic circuit diagram of one preferred embodiment of the invention, FIG. 2 is a schematic circuit diagram of another preferred embodiment of the invention, and FIG. 3 is a schematic circuit diagram of a still further preferred embodiment of the invention.

The alarm circuit of this invention, in accordance with the embodiment of FIG. 1, includes an alarm condition indicating section 10, an alarm condition sensing section 12, and a circuit test section 14. When the alarm condition sensing section 12 senses an alarm condition, such as opening of a door or window or removal of an object, an electrical switch 12*a* is actuated, which in turn is effective to actuate an alarm indicator 10*a* of the alarm condition indicating section 10 to provide a humanly perceptible alarm, such as ringing a bell, flashing a light, etc. The test circuit 14, in response to momentary actuation of a test switch 14*a* energizes a test indicator 14*b* providing a humanly perceptible indication, such as a flash of light, if the circuit connections to the alarm condition sensing switch 12*a* from the alarm condition indicating section 10 are complete and the power supply of the alarm condition indicating section 10 is in an operative condition.

The alarm condition indicating section 10, considered in more detail, includes the alarm indicator 10*a* which is connected to a source of power 16 via a normally open switch 18 and lines 10, 20 and 21. To maintain the switch 18 in its normally open circuit condition in the absence of an alarm condition, thereby preventing energization or deactuation of the alarm indicator 10*a* and in turn preventing production of an alarm indication, such as ringing of a bell or flashing of a lamp, a control element in the form of a relay 22 is provided. Relay 22 is connected between power supply lines 20 and 21 via a current limiting resistor 23. The relay 22 normally, that is, in the absence of an alarm condition, is in an energized condition, i.e., is deactuated, placing its associated relay contact 18, or switch, in the normally open circuit or deactuated condition as shown in FIG. 1, which in turn de-energizes or deactuates the alarm indicator 10*a* to prevent the production of an alarm. However, should the relay 22 become de-energized in response to an alarm condition, in a manner to be described, the normally open circuit delay contact 18 is actuated, that is, transfers from the position shown in FIG. 1 to a closed circuit condition, energizing or actuating the alarm indicator 10*a* which, as indicated, when energized will provide an alarm indication such as flashing a lamp or sounding a siren.

To de-energize the normally energized relay 22 and in turn actuate the switch 18 to its closed circuit condition to actuate the alarm indicator 10*a* and provide an indication of an alarm, the normally open circuit alarm condition sensing switch 12*a* is connected in shunt with the relay 22 via lines 25 and 26. The normally open circuit alarm condition sensing switch 12*a* may be mechanically coupled to a normally closed door or window which, upon opening of the door or window, transfers the switch 12*a* from its normally open circuit position shown in FIG. 1 to a closed circuit condition. Alternatively, the normally open circuit alarm condition sensing switch 12*a* could be mechanically coupled to an object which, upon removal of the object, transfers the switch 12*a* from its normally open position shown in FIG. 1 to a closed circuit position.

Regardless of the specific manner in which normally open circuit alarm condition sensing switch 12*a* is actuated, so long as the switch 12*a* remains in its normally open circuit condition the relay 22 remains energized, leaving its associated switch contact 18 in an open circuit condition and the alarm indicator 10*a* de-energized, producing no alarm. However, should the normally open circuit alarm condition sensing switch 12*a* be transferred to its closed circuit condition in response to the occurrence of an alarm condition the relay 22 is short-circuited or shunted, becoming deactuated, i.e., de-energized. De-energization of relay 22 transfers normally open circuited relay contact 18 to a closed circuit condition to energize the alarm indicator 10*a* and provide an alarm.

To enable the alarm condition indicating section 10 to be tested with respect to both continuity of the connections from the power supply 16 to the alarm condition sensing switch 12*a* as well as with respect of the operability of the power supply 16, the test circuit section 14 is provided. The circuit test section 14 includes an energy storage device 28, preferably a capacitor, which is connected across the alarm condition sensing switch 12*a* via a current limiting resistor 30. The capacitor 28, assuming the connections from the power supply 16 to the alarm condition sensing switch 12*a* are complete and the power supply 16*a* is operative, normally charges via the current limiting resistor 30 to slightly less than the open circuit voltage across the normally open switch 12*a*. The resistance of the current limiting resistor 30 must be selected to be sufficiently large to prevent short-circuiting or shunting of the normally energized relay 22. Obviously, if connection of the circuit test section 14 across the alarm condition sensing switch 12*a* places a sufficiently low impedance across the normally energized relay 22, relay 22 will be short-circuited producing an alarm indication, albeit a false alarm, from indicator 10*a* in much the same manner as if the normally open alarm condition sensing switch 12*a* were closed in response to an alarm condition. Thus, the current limiting impedance 30, while permitting the capacitor 28 to charge to slightly less than the open circuit voltage normally present across switch 12*a*, prevents short-circuiting and de-energization of the relay 22 which, if permitted to occur, would energize the alarm indicator 10*a* and provide a false alarm. Connected across the capacitor 28 is a series circuit including a normally open test switch 14*a*, a current limiting resistor 32 and the test indicator 14*b* which, in a preferred embodiment, is a light-emitting diode.

Assuming the power supply 16 is operative and the circuit connections therefrom to the normally open alarm condition sensing switch 12*a* are complete, the capacitor 28 will charge to slightly less than the open circuit voltage across alarm switch 12*a*. When the test switch 14*a* is momentarily closed, the capacitor 28 will discharge through the light-emitting diode 14*b* providing a visually perceptible flash to indicate that the power supply 16 is operative and that the connections to the normally open alarm condition sensing switch 12*a* are complete. The current limiting resistor 32 protects the light-emitting diode 14*b* from damaging current levels when the test switch 14*a* is momentarily closed to discharge the capacitor 28.

Should the capacitor 28 have become charged due to the operative condition of the power supply 16 and completion of the connections therefrom to the normally open alarm condition sensing switch 12*a*, it is possible that upon momentary closure of the test switch 14*a* the capacitor 28 could discharge through the test indicator 14*b* providing a false indication if, subsequent to charging of the capacitor but prior to the actuation of the test switch 14*a* the power supply 16 became inoperative and/or the wiring from the power supply to the alarm condition sensing switch 12*a* became interrupted. To avoid such a false indication a resistor 36 is connected across capacitor 28. Resistor 36 has a resistance which is much larger than that of the resistor 30 to allow the capacitor 28 to charge when the power supply 16 is operative and the wiring therefrom to the switch 12*a* complete. However, should either the power supply 16 become inoperative or the wiring therefrom to the switch 12*a* become incomplete subsequent to charging of the capacitor 28 but before closing of the test switch 14*a*, the charge on the capacitor 28 will dissipate through the resistor 36 leaving the capacitor 28 in a discharged condition. If the test switch 14*a* is now momentarily closed there is no energy stored in the capacitor 28 to discharge through the light-emitting diode 14*b*. As a consequence, the light-emitting diode 14*b* does not flash and a false indication of the operability of the power supply 16 and/or the completion of the wiring from the power supply to the alarm condition sensing switch 12*a* is not provided.

In the preferred embodiment shown in FIG. 1, the capacitor 28 in the circuit test section 14 stores electrical energy provided by the power supply 16 which provides power to the alarm condition indication section 10 of the circuit. If the impedance of the alarm condition sensing section 12 is small, as is the case in the preferred embodiment depicted in FIG. 1, the capacitor 28 of the test section 14 can store sufficient electrical energy to actuate the test indicator 14*b* upon closure of the test switch 14*a*. However, under certain circumstances the impedance of the alarm condition sensing section may be so large that the energy storing element of the circuit test section cannot be supplied with sufficient energy from the power supply of the alarm condition indicator section to actuate the test indicator of the circuit test section when the test switch is momentarily closed. Under such circumstances, a separate power supply, such as a battery, can be incorporated in the circuit test section. The battery incorporated in the circuit test section provides energy to the storage element of the circuit test section, assuming the power supply of the alarm condition indicating circuit section, which power supply is separate from that of the circuit test section, is operative and connected to the alarm condition sensing section. A circuit of the type described, incorporating a separate power supply in the circuit test section, is depicted in FIG. 2.

With reference to FIG. 2, the circuit includes an alarm condition indicating section 40, an alarm condition sensing section 42 and a circuit test section 44. The alarm condition indicating section 40 provides a humanly perceptible indication, such as an audible or visual alarm, upon sensing an alarm condition at a protected premise, such as opening of a normally closed door or window or removal of an object. The circuit test section 44 provides, when a test switch 44*a* is momentarily actuated, a humanly perceptible indication reflecting the fact that the power supply incorporated in the alarm condition indicating section 40 is operative and that circuit continuity exists between an alarm condition sensing element 42*a* of the alarm condition sensing section 42 and the power supply of the alarm condition indicating section 40.

The alarm condition indicator section 40 includes an alarm condition indicator 40*a*, such as a siren, lamp, or the like, which is connected via a transistor switch 48 to the output lines 49 and 50 of the power supply 52. Under normal conditions, that is, in the absence of an alarm condition at the protected premise whereat the alarm condition sensing element 42*a* is located, the transistor switch 48 is nonconductive and the alarm indicator 40*a* provides no humanly perceptible alarm indication. To sense a change in impedance of the alarm condition sensing section 42 in response to actuation of the sensing element 42*a* when an alarm condition is sensed, and thereby switch the transistor 48 to a conductive state and actuate the indicator 40*a*, the base of the transistor 48 is provided with a suitable biasing network which normally maintains the transistor 48 biased to its nonconductive state. The biasing network includes resistors 53 and 54 connected between the power supply output line 50 and the base of a transistor 51. Transistor 51 has its emitter connected to line 49 and its collector connected to line 50 via a resistor 58. The collector of transistor 51 is connected to the base of transistor 48. Also included in the biasing network is a zener diode 56 connected between the junction of resistors 53 and 54 and the power supply line 49. This biasing network in the absence of an alarm condition maintains transistor switch 51 conductive and transistor switch 48 nonconductive, deactuating or disabling the alarm indicator 40*a*. However, should an alarm condition be sensed by the alarm condition sensing element 42*a* of the alarm condition sensing section 42, the impedance of the alarm condition sensing section 42 increases, switching transistor 51 which is normally conductive to a nonconductive state which in turn switches transistor 48 to its conductive state, actuating the alarm indicator 40*a*.

The alarm condition sensing section 42 includes a photoconductor 42*a* connected between line 60 and the power supply output line 49. The photoconductor 42*a* exhibits a high impedance when incident with a low level of light and a low impedance when incident with a high level of light. The photoconductor 42*a* may, for example, be located beneath an object, the movement of which it is desired to detect. So long as the object remains in position covering the photoconductor 42*a*, the level of light incident on the photoconductor is low and the impedance exhibited by the photoconductor is high. Under such circumstances, the current flow through the photoconductor 42*a* of the alarm condition sensing section 42 is small and the transistor switch 51 remains conductive and transistor switch 48 remains nonconductive, deactuating the alarm indicator 40*a*. However, should the object be removed the level of light indicent on the photoconductor 42*a*, such as ambient light from the surroundings, will increase since the photoconductor 42*a* is no longer blocked by the object. The increased level of light incident on the photoconductor 42*a* causes the impedance thereof to decrease, in turn increasing the current flow through the alarm condition sensing section 42 which switches the transistor 51 to a nonconductive state and transistor 48 to its conductive state, actuating the alarm indicator 40*a*.

The circuit test section 44, now to be described, permits testing of the operability of the power supply 52 of the alarm condition indicating section 40, as well as the electrical continuity of the wiring between the alarm condition sensing element 42*a* and the alarm condition indicating section 40, particularly the power supply 52 thereof. The circuit test section 44 includes the test switch 44*a* and a test indicator 44*b*. The test switch 44*a* may be any normally open circuit push-button switch, while the test indicator 44*b* in a preferred form is a light-emitting diode. If the power supply 52 of the alarm condition indicator section 40 is operative and continuity exists between it and the terminals of the alarm condition sensing element 42*a* of the alarm condition sensing section 42, when the test switch 44*a* is momentarily closed the test indicator 44*b* will flash providing an indication that both the power supply 52 is operative and continuity exists therefrom to the alarm condition sensing element 42*a*.

Also included in the circuit test section 44 is an energy storage element 62, preferably a capacitor, connected across the test switch 44*a*, a current limiting resistor 63 and the test indicator 44*b*. To charge the capacitor 62 when the power supply 52 is operative and continuity exists therefrom to the alarm condition sensing element 42*a*, an independent power supply 64, such as a 9-volt battery, is provided in combination with a transistor switch 66 having its emitter-collector path connected between the capacitor 62 and the battery 64. The base of the transistor 66 is connected to one terminal of the alarm condition sensing element 42*a* while the emitter thereof is connected to the other terminal of the sensing element 42*a*. Under normal circumstances, that is, when the power supply 52 of the alarm condition indicating section 40 is operative and continuity therefrom to the alarm condition sensing element 42*a* exists, the transistor switch 66 is biased to a conductive state permitting the capacitor 62 to charge from the battery 64 via a current limiting resistor 68 in series with the battery. Thus, assuming the power supply 52 is operative and continuity therefrom to the alarm condition sensing element 42*a* exists, the capacitor 62 is charged. When the test switch 44*a* is then actuated the energy stored in the capacitor 62 discharges through the test indicator 44*b* providing a flash of light indicating that both the power supply 52 is operative and electrical continuity therefrom exists to the alarm condition sensing element 42*a*.

A large resistance 70 is connected across the capacitor 62 to discharge energy stored in the capacitor 62. This prevents a false positive test indication when the test switch 44*a* is momentarily closed should, subsequent to charge of the capacitor 62 but prior to closure of the test switch 44*a*, the power supply 52 becomes inoperative and/or continuity therefrom to the alarm condition sensing element 42*a* cease to exist. Were the resistor 70 not connected across capacitor 62 a false positive test indication is possible. Specifically, in the absence of resistor 70, it is possible for the capacitor 62 to become charged during a period when the power supply 52 is operative and continuity therefrom to the alarm condition sensing element 42*a* exists, and to remain charged thereby providing energy to flash the light-emitting diode 44*b* when the test switch 44*a* is momentarily closed even though subsequent to charging of the capacitor 62 and prior to momentary closure of the test switch 44*a* the power supply 52 has become inoperative and/or the continuity from the power supply 52 to the alarm condition sensing element 42*a* has ceased to exist or otherwise become interrupted.

The circuit test section 44, like the circuit test section 14, enables testing of the power supply 52 of the alarm condition indicator section 40, as well as checking of the continutiy between the power supply 52 of the alarm indicator section 40 and the alarm condition sensing element 42*a*, without shunting the alarm condition sensing element 42*a*, which if occurred would simulate an alarm condition and cause the alarm condition indicator 40*a* to provide a false indication of an alarm condition.

While the power source 16 of FIG. 1 is shown as a DC source with line 21 positive and line 20 negative, the power source could provide alternating current in which case a rectifying diode 75 should be connected as shown in phantom on FIG. 1.

In certain applications it is desirable to connect a plurality of alarm condition sensors and associated circuit testers in parallel circuit arrangement with a single alarm condition indicator. Since the net impedance of the multiple parallel-connected alarm condition sensors and associated circuit testers, when none of the alarm sensors is actuated, decreases as the number of individual alarm condition sensors and associated circuit testers increases, it is essential that the impedance of each individual alarm condition sensor and associated circuit tester be selected such that when the multiple alarm condition sensors and associated circuit testers are connected in parallel across a single alarm condition indicator the net resistance of the parallel combination not be so low that the control element for the alarm indicator is activated when none of the alarm sensors have been activated.

In the circuit of FIG. 1 it was noted that the resistor 36 must have an impedance sufficiently high to prevent short-circuiting the control relay 22 when the alarm sensor 12*a* is not actuated, that is, when the switch 12*a'* is in the open circuit condition. If in the circuit of FIG. 1, multiple alarm condition sensing sections 12 and associated circuit test sections 14 are connected in parallel to lines 25 and 26 across the single control element or relay 22, it might be possible to insure that the net resistance of the parallel-connected network of multiple alarm condition sensors and associated circuit testers is sufficiently high to avoid short-circuiting relay 22 when none of the alarm sensors 12*a* is in a closed circuit condition by substantially increasing the impedance of the resistor 36 of each of the parallel-connected alarm condition sensing and circuit test networks. However, there is a limit to the amount the impedance of resistor 36 of each such parallel-connected circuit can be increased since, if the value of each resistor 36 is too high, the capacitor 28 of each circuit test section 14 would not discharge within a reasonable period of time after de-energization of power supply 16 and/or interruption of the connection thereof to the sensor 12, providing false test indications when test switch 14*a* is thereafter actuated.

The circuit of FIG. 3 is designed to accomodate multiple parallel-connected alarm condition sensors and associated circuit testers connected across a single alarm condition indicator without falsely actuating the control element, that is, without actuating the control element when none of the parallel-connected alarm sensors has been placed in a closed circuit condition, and yet permit the energy storage devices or capacitors of each of the parallel-connected circuit testers to discharge within a reasonable period after de-energization of the power supply and/or disconnection thereof to the alarm condition sensors.

With reference to FIG. 3, the alarm condition indicating section 10' includes a DC power source 16' across which is connected the series combination of an alarm indicator 10*a'* and a normally open contact 18'. Contact 18' is controlled by a normally energized control element or relay 22' connected across the power source 16' via a resistor 23'. Connected in parallel across the relay 22' of the alarm condition indicator 10' are a plurality of alarm condition sensors and associated circuit testers 12', 14' and 12'',14''. Since each alarm condition , 14''and associated circuit tester is identically constructed, only alarm condition sensor 12' and circuit tester 14' are described.

Alarm condition sensing section 12' includes an alarm sensor 12*a'* which in the form indicated is a normally open switch which is closed in response to occurrence of an alarm condition, such as unauthorized entry through a window or door protected by the alarm sensor. The alarm sensor switch 12*a'* is connected across the relay 22' of the alarm condition indicator 10' via lines 25' and 26'. Connected across the alarm sensor 12*a'* is a circuit test section 14' which includes an energy storage device in the form of a capacitor 28' designed to charge through a resistor 30' when the power source 16' is energized and the connection to lines 25' and 26' complete. When the capacitor 28' is charged the voltage thereacross is slightly less than the open circuit voltage across the relay 22'. The circuit test section 14', in addition to capacitor 28', also includes the series combination of a normally open test switch 14*a'*, a current limiting resistor 32', and a test indicator, such as a light-emitting diode 14*b'*, the series combination being connected across capacitor 28'. Assuming the power source 16' is energized and the connection thereof to lines 25' and 26' complete, the capacitor 28' will be charged. When the test switch 14*a'* is now momentarily closed the capacitor 28' will discharge through the current limiting resistor 32' and the light-emitting diode 14*b'*, causing the light-emitting diode to emit a light flash. The light flash provides a visual indication to the operator who momentarily closes the test switch 14*a'* that the power source 16' is energized and the connection thereof to lines 25' and 26' complete.

To facilitate discharge of the capacitor 28' should the power source 16' become de-energized and/or the connection thereof to lines 25' and 26' be interrupted after the capacitor 28' has had an opportunity to fully charge but before the test switch 14*a'* is actuated, a transistor Q' having its emitter-collector path connected in parallel with capacitor 28' is provided in combination with a resistor 70' which is also connected in parallel with the capacitor 28' and a diode 71' connected between the transistor base and emitter electrodes. The base of the transistor Q' is also connected to the negative line 26'.

In operation, when the power source 16' is energized and the connection thereof to lines 25' and 26' is complete, transistor Q' is held in a nonconductive state due to the absence of a forward bias on the transistor base-emitter junction. Since the resistance of resistor 70' is large, for example, 200K ohms, and the resistance of the nonconducting transistor Q' is also very large, the net resistance of multiple parallel-connected alarm condition sensors and associated circuit testers connected in parallel across the single control relay 22' will be maintained at a sufficiently large value to avoid short-circuiting of the relay 22' and production of an indication from the alarm indicator 10*a'* when none of the alarm sensors have been actuated. However, should the power source 16' become de-energized and/or the connection thereof to lines 25' and 26' become interrupted, the charged capacitor 28' will bias the transistor Q' into conduction to discharge the capacitor 28'. Specifically, if the power source 16' becomes disconnected, a discharge path for the capacitor 28' exists through resistor 70', which path is blocked by diode 71', causing a forward bias to be applied to the transistor base-emitter junction to render the transistor Q' conductive. Once transistor Q' conducts, the capacitor 28' further discharges through both resistor 70' and the emitter-collector path of the transistor. Due to the low resistance of the emitter-collector path of the now conducting transistor Q', discharge is effected rapidly. Should the power source 16' be de-energized (vis-a-vis connection thereof to capacitor 28 terminated), the transistor Q′ is switched to a conductive state to effect rapid capacitor discharge, but the initial discharge path which effects transistor switching is primarily through relay coil 22′ rather than resistor 70′. Thus, with capacitor 28′ discharged, when the test switch **14*a*′ is thereafter momentarily actuated, the test indicator 14*b*′ will not provide a flash indicating that the circuit is operative when in fact the power source 16′ is de-energized and/or the connection thereof lines 25′ and 26′** has become interrupted.

What is claimed is:

1. An alarm condition responsive and indicating circuit testable to determine the operability thereof, comprising:

a power supply, an alarm indicator connected to said power supply, a first electrical switch connected in circuit with said power supply and alarm indicator, said first switch having activated and deactivated states for controlling the energization of said alarm indicator by said power supply, said first switch when activated placing said alarm indicator in a predetermined energization state to provide an alarm indication, an electrical control element connected to said power supply and having relatively conductive and nonconductive states, said control element controlling said first electrical switch to activate it and produce said alarm indication when said control element is rendered in its relatively nonconductive state and to deactivate said first switch when said control element is rendered in its relatively conductive state, a second switch responsive to alarm conditions connected to electrically shunt said control element when said second switch is placed in an electrically conductive state in response to sensing an alarm condition, whereby said electrically shunted control element is placed in its relatively nonconductive state to activate said first switch and produce said alarm indication, said second switch normally being in a nonconductive state in the absence of an alarm condition to place said control element in its relatively conductive state and deactivate said first switch, an energy storage element having an impedance in series therewith, said storage element and impedance being connected across said second switch to store electrical energy in said storage element when said power supply is operative and connected to said second switch, said impedance having a resistance sufficient to avoid rendering said control element relatively nonconductive, a test switch, a test indicator connected in series with said test switch, said test switch and test indicator being connected in circuit with said storage element to energize said test indicator with energy stored in said storage element when said test switch is activated, thereby providing an indication that said power supply is operative and connected to said second switch.

2. The circuit of claim 1 further including means connected to said energy storage element to dissipate energy stored in said storage element upon interruption of the supply of energy from said power supply to said storage element, thereby preventing energization of said test indicator by energy stored in said storage element when said test switch is activated subsequent to interruption of the supply of energy to said storage element from said power supply.

3. The circuit of claim 2 wherein said energy storage element is a capacitor and said energy dissipation means is a resistor connected across said capacitor, said resistor having larger resistance than said impedance to permit said capacitor to charge, when said power supply is providing energy to said capacitor, to a level sufficient to energize said test indicator upon activation of said test switch.

4. An alarm condition responsive and indicating circuit testable to determine the operability thereof, comprising:

a power supply, an alarm indicator connected to said power supply, a first switch connected in circuit with said alarm indicator to actuate said alarm indicator when said first switch is actuated, a control element connected to said power supply for deactuating and actuating said first switch to thereby deactuate and actuate said alarm indicator, respectively, an alarm switch connected to said control element to deactuate and actuate said control element in turn deactuating and actuating said first switch and alarm indicator in response to the absence and presence of an alarm condition, respectively, a current limiting resistor, an energy storage element connected to said alarm switch through said current limiting resistor for storing energy without actuating said control element and in turn said first switch and alarm indicator, and a test indicator connected to said energy storage element, said test indicator being actuated upon transfer of energy thereto from said energy storage element to provide an indication reflecting the supply of energy to said alarm switch from said power supply.

5. The circuit of claim 4 further including means connected to said storage element to dissipate energy stored in said storage element upon interruption of the supply of power to said alarm switch, thereby preventing actuation of said test indicator should the supply of energy to said alarm switch be interrupted subsequent to storage of energy in said storage element.

6. An alarm condition responsive and indicating circuit having power supply operability and circuit continuity testing capability, comprising:

alarm means having a pair of input terminals, including a power supply connected to said terminals, providing an alarm when a low impedance is connected between said terminals, circuit means connected across said terminals, said circuit means responsive to an alarm condition and exhibiting low impedance when an alarm condition exists, to cause said alarm means to produce an alarm, and a high impedance in the absence of an alarm condition, a capacitor and a high impedance connected in series across said terminals for storing energy from said power supply in said capacitor without causing said alarm means to produce an alarm, and a test switch and test indicator connected in series across said capacitor for discharging said capacitor through said test indicator when said switch is actuated to produce an indication that said terminals are connected to said power supply and said power supply is operative.

7. The circuit of claim 6 further including means connected to said capacitor to discharge energy stored therein should said power supply become inoperative and/or said connection thereof to said terminals become interrupted, thereby avoiding a false test indication upon actuation of said test switch.

8. An alarm condition responsive and indicating circuit having power supply operability and circuit continuity testing capability, comprising:

alarm means having a pair of input terminals, including a first power supply connected to said terminals, providing an alarm when a low impedance is connected between said terminals, circuit means connected across said terminals, said circuit means responsive to an alarm condition and exhibiting low impedance when an alarm condition exists, to cause said alarm means to produce an alarm, and a high impedance in the absence of an alarm condition, a second power supply which is independent of said first power supply, a capacitor and a first switch connected in circuit with said second power supply to charge said capacitor from said second power supply when said switch is in a low impedance condition, said switch being connected to said terminals and switched to its low impedance condition to enable said capacitor to charge from said second power supply in response to the supply of power to said terminals from said first power supply, and a test switch and test indicator connected in series across said capacitor for discharging said capacitor through said test indicator when said test switch is actuated to produce an indication that said terminals are connected to said first power supply and said first power supply is operative.

9. The circuit of claim 8 further including means connected to said capacitor to discharge energy stored therein when said first power supply becomes inoperative and/or said connection thereof to said terminals becomes interrupted, thereby avoiding a false test indication upon actuation of said test switch.

10. The circuit of claim 9 wherein said capacitor discharge means includes a resistor connected across said capacitor which discharges said capacitor when said first switch is switched from its low impedance state in response to termination of the supply of power to said terminals from said first power supply.

11. An alarm condition responsive and indicating circuit having power supply operability and circuit continuity testing capability, comprising:

alarm means having a pair of input terminals, including a power supply connected to said terminals, providing an alarm when a low impedance is connected between said terminals, first circuit means connected across said terminals, said first circuit means responsive to an alarm condition and exhibiting low impedance when an alarm condition exists, to cause said alarm means to produce an alarm, and a high impedance in the absence of an alarm condition, a capacitor, a second circuit means connecting said capacitor to said terminals to permit said capacitor to store energy when said terminals are connected to said power supply and said power supply is operative, and a test switch and test indicator connected in series across said capacitor for discharging said capacitor through said test indicator when said switch is actuated to produce an indication that said terminals are connected to said power supply and said power supply is operative.

12. The circuit of claim 2 wherein said energy storage element is a capacitor and said energy dissipating means includes:

a. a transistor having its emitter-collector path connected across said capacitor, said transistor being nonconductive when said power supply is providing energy to said capacitor, to permit said capacitor to charge to a level sufficient to energize said test indicator upon activation of said test switch, and b. bias means connected to said transistor for rendering said transistor conductive to discharge said capacitor when said power suppy is not providing energy to said capacitor.

13. The circuit of claim 12 wherein said bias means includes a resistor connected between said transistor base and collector and diode connected between said transistor base and emitter.

14. An alarm condition responsive and indicating circuit testable to determine the operability thereof, comprising:

a power supply, an alarm indicator connected to said power supply, a first electrical switch connected in circuit with said power supply and alarm indicator, said first switch having activated and deactivated states for controlling the energization of said alarm indicator by said power supply, said first switch when activated placing said alarm indicator in a predetermined energization state to provide an alarm indication, a single electrical control element connected to said power supply and having relatively conductive and nonconductive states, said control element controlling said first electrical switch to activate it and produce said alarm indication when said control element is rendered in its relatively nonconductive state and to deactivate said first switch when said control element is rendered in its relatively conductive state, a plurality of testable alarm condition networks, each including:

a. a second switch responsive to alarm conditions connected to electrically shunt said control element when said second switch is placed in an electrically conductive state in response to sensing an alarm condition, whereby said electrically shunted control element is placed in its relatively nonconductive state to activate said first switch and produce said alarm indication, said second switch normally being in a nonconductive state in the absence of an alarm condition to place said control element in its relatively conductive state and deactivate said first switch, b. a capacitor having an impedance in series therewith, said capacitor and impedance being connected across said second switch to store electrical energy in said capacitor when said power supply is operative and connected to said second switch, said impedance having a resistance sufficient to avoid rendering said control element relatively nonconductive, c. a test switch, d. a test indicator connected in series with said test switch, e. said test switch and test indicator being connected in circuit with said capacitor to energize said test indicator with energy stored in said capacitor when said test switch is activated, thereby providing an indication that said power supply is operative and connected to said second switch, f. means connected to said capacitor to dissipate energy stored therein upon interruption of the supply of energy from said power supply to said capacitor, thereby preventing energization of said test indicator by energy stored in said capacitor when said test switch is activated subsequent to interruption of the supply of energy to said capacitor from said power supply, said energy dissipation means including:

i. a transistor having a base, emitter and collector with its emitter-collector path connected across said capacitor, said transistor being nonconductive when said power supply is providing energy to said capacitor, to permit said capacitor to charge to a level sufficient to energize said test indicator upon activation of said test switch, and ii. bias means connected to said transistor for rendering said transistor conductive to discharge said capacitor when said power supply is not providing energy to said capacitor.

15. The circuit of claim 14 wherein each said bias means includes a resistor connected between said base and collector of its respectively associated transistor and a diode connected between said base and emitter of its respectively associated transistor.

16. The circuit of claim 9 wherein said capacitor discharge means includes:

a. a transistor having its emitter-collector path connected across said capacitor, said transistor being nonconductive when said second power supply is providing energy to said capacitor, to permit said capacitor to charge to a level sufficient to energize said test indicator upon activation of said test switch, and b. bias means connected to said transistor for rendering said transistor conductive to discharge said capacitor when said second power supply is not providing energy to said capacitor.

17. The circuit of claim 16 wherein said bias means includes a resistor connected between said transistor base and collector and a diode connected between said transistor base and emitter.

* * * * *

UNITED STATES PATENT OFFICE

CERTIFICATE OF CORRECTION

PATENT NO. : 3,955,183

DATED : May 4, 1976

INVENTOR(S) : John E. McBrian

It is certified that error appears in the above-identified patent and that said Letters Patent are hereby corrected as shown below:

Column 1, line 23: "indication" should be -- indicating---.

Column 3, line 41: "alrmm" should be --alarm--.

Column 4, line 30: "delay" should be --relay--.

Column 6, line 13: "indication" should be --indicating--.

Column 9, line 60: " , 14" " should be --sensor--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*